United States Patent [19]

Shapland et al.

[11] Patent Number: 4,582,232

[45] **Date of Patent: * Apr. 15, 1986**

[54] VALVE, CLAMP, REFRACTORY AND METHOD

[75] Inventors: George T. Shapland, White Heath; Patrick D. King, Rantoul; Gary R. Polk, Savoy; Randall L. Stalter, Mahomet, all of Ill.

[73] Assignee: Flo-Con Systems, Inc., Champaign, Ill.

[ * ] Notice: The portion of the term of this patent subsequent to Mar. 4, 2003 has been disclaimed.

[21] Appl. No.: 622,234

[22] Filed: Jun. 19, 1984

[51] Int. Cl.[4] ..... B22D 41/08

[52] U.S. Cl. ..... 222/600; 222/606

[58] Field of Search ..... 222/164, 591, 598, 600, 222/606, 607, 512, 561; 251/349, 326, 353, 176; 137/242; 266/236, 271

[56] References Cited

U.S. PATENT DOCUMENTS

| | | | |
|---|---|---|---|
| 3,478,771 | 11/1969 | Johnson | 137/242 |
| 3,942,690 | 3/1976 | Lohrer | 222/512 |
| 4,042,207 | 8/1977 | Nehrlich et al. | 251/62 |
| 4,063,668 | 12/1977 | Shapland et al. | 222/512 |
| 4,179,046 | 12/1979 | Jeschke et al. | 222/603 |
| 4,182,466 | 1/1980 | Fehling et al. | 222/600 |

FOREIGN PATENT DOCUMENTS

| | | | |
|---|---|---|---|
| 51-540 | 1/1976 | Japan | 222/600 |
| 374454 | 3/1964 | Switzerland | 222/600 |
| 2083896 | 3/1982 | United Kingdom | 222/591 |
| 2094954 | 9/1982 | United Kingdom | 222/600 |

OTHER PUBLICATIONS

Detrick Co., advertising, Iron and Steel Engineer, 4–1978, p. 11, "Interstop".

*Primary Examiner*—Joseph J. Rolla
*Assistant Examiner*—Nils E. Pedersen
*Attorney, Agent, or Firm*—Jack E. Dominik

[57] ABSTRACT

Disclosed is a sliding gate valve and clamp mechanism which permits the utilization of bandless refractory for the top plate, sliding gate, and the attachment of a replaceable collector to the sliding gate. The refractory is formed with curvilinear side edges tapered centrally toward the inter face portion between the top plate and sliding gate plate. Curvilinear edges are employed on both the stationary plate and the sliding gate, and desirably both have an identical exterior configuration, but optionally differ in the central portion where the well block nozzle is engaged by the stationary plate and where the collector is engaged by the sliding gate plate. Optionally a secondary sealing ring is employed to form a seal between the lower well nozzle and the top plate in a zero clearance environment. Also desirably the top plate and sliding gate plate may both be ground on both faces to provide parallelism and planarity of the refractory faces. In certain embodiments the stationary plate and slide gate are identical.

24 Claims, 11 Drawing Figures

REFRACTORY SHAPE

VALVE, CLAMP, REFRACTORY AND METHOD

FIELD OF THE INVENTION

The present invention relates to a sliding gate valve, and more particularly to a bandless type refractory system and clamping means for securing the same in the valve.

SUMMARY OF THE PRIOR ART

The prior art is exemplified by Shapland et al, U.S. Pat. No. 4,063,668 issued Dec. 20, 1977 which discloses the general environment of a sliding gate valve having a carrier, a stationary plate, a sliding plate and a collector nozzle extending downwardly from the sliding plate. The entirety is designed so that a plurality of pressure pads bear against the underneath portion of the sliding plate and secure the same in pressure face-to-face relationship with the stationary plate. With the refractory of the subject Shapland et al patent, there is a requirement that the refractory members, particularly the sliding gate and top plate be almost fully encased in metal. The purpose of the metal encasement is to restrain the same against cracking and crumbling due to the thermal shock encountered during the pouring of molten steel. In addition, the collector nozzle has a unitary metallic housing with the metallic housing for the sliding gate plate.

Now that sliding gate valves have become common place in various steel mills, efforts have been made to reduce the cost per ton of servicing the sliding gate valve. Also continued efforts are underway to increase the number of pours which can be made without changing refractory, and upgrade the quality of the refractories. In this connection, achieving planarity between both faces of the refractory is important. With the development of the spring pressure plate and depending mechanism for securing the collectors to the slide gate, the possibility exists for applying the spring pressure directly to the pressure plate, and then eliminating the underneath metallic portion of the slide gate plate. It therefore became highly desirable to develop a slide gate plate structure in the form of a totally bandless refractory for both the top plate and the slide gate which permits grinding the faces of both to be coplanar, and to reduce the cost of the slide gate and stationary plate by eliminating the metallic encasement.

SUMMARY OF THE INVENTION

The present invention is directed to a sliding gate valve and clamp mechanism which permits the utilization of bandless refractory for the top plate, sliding gate, and the attachment of a replaceable collector to the sliding gate. The refractory is formed with curvilinear side edges tapered centrally toward the inter face portion between the top plate and sliding gate plate. Curvilinear edges are employed on both the stationary plate and the sliding gate, and desirably both have an identical exterior configuration, but optionally differ in the central portion where the well block nozzle is engaged by the stationary plate and where the collector is engaged by the sliding gate plate. Optionally a secondary sealing ring is employed to form a seal between the lower well nozzle and the top plate in a zero clearance environment. Also desirably the top plate and sliding gate plate may both be ground on both faces to provide parallelism and planarity of the refractory faces. In certain embodiments the stationary plate and slide gate are identical.

A principal object of the present invention is to provide a sliding gate valve assembly which accommodates bandless refractory, and a refractory which can be formed with planarity and parallelism between its opposed faces.

Another object of the present invention is to provide a refractory for use in a bandless system in which the sliding gate plate and the stationary plate are essentially of identical configuration.

Still another advantage of the present invention is to provide a bandless refractory in which a zero clearance secondary seal can be achieved between the stationary plate and its associated mounting plate sealing ring.

Yet another object of the present invention is to provide a collector nozzle for replaceable use in conjunction with a bandless sliding gate plate.

Yet a further object of the present invention is to achieve longevity in use of the subject refractory.

BRIEF DESCRIPTION OF THE DRAWINGS

Further objects and advantages of the present invention will become apparent as the following description of an illustrative embodiment proceeds, taken in conjunction with the accompanying drawings, in which.

DESCRIPTION OF A PREFERRED EMBODIMENT

Figure 1:
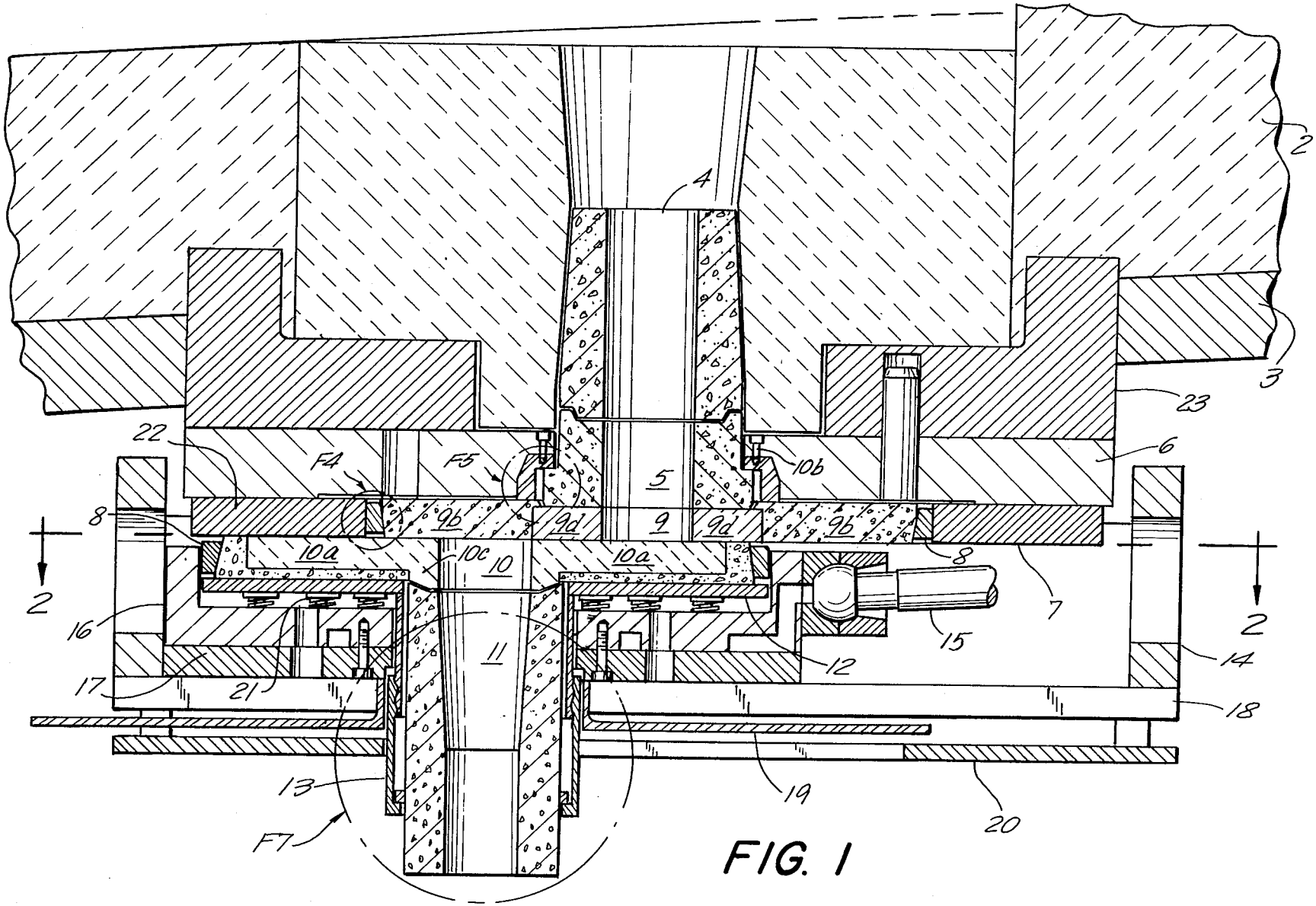
FIG. 1 is a transverse sectional view of a typical teeming vessel fitted to utilize a sliding gate valve having a bandless refractory.
Figure 2:
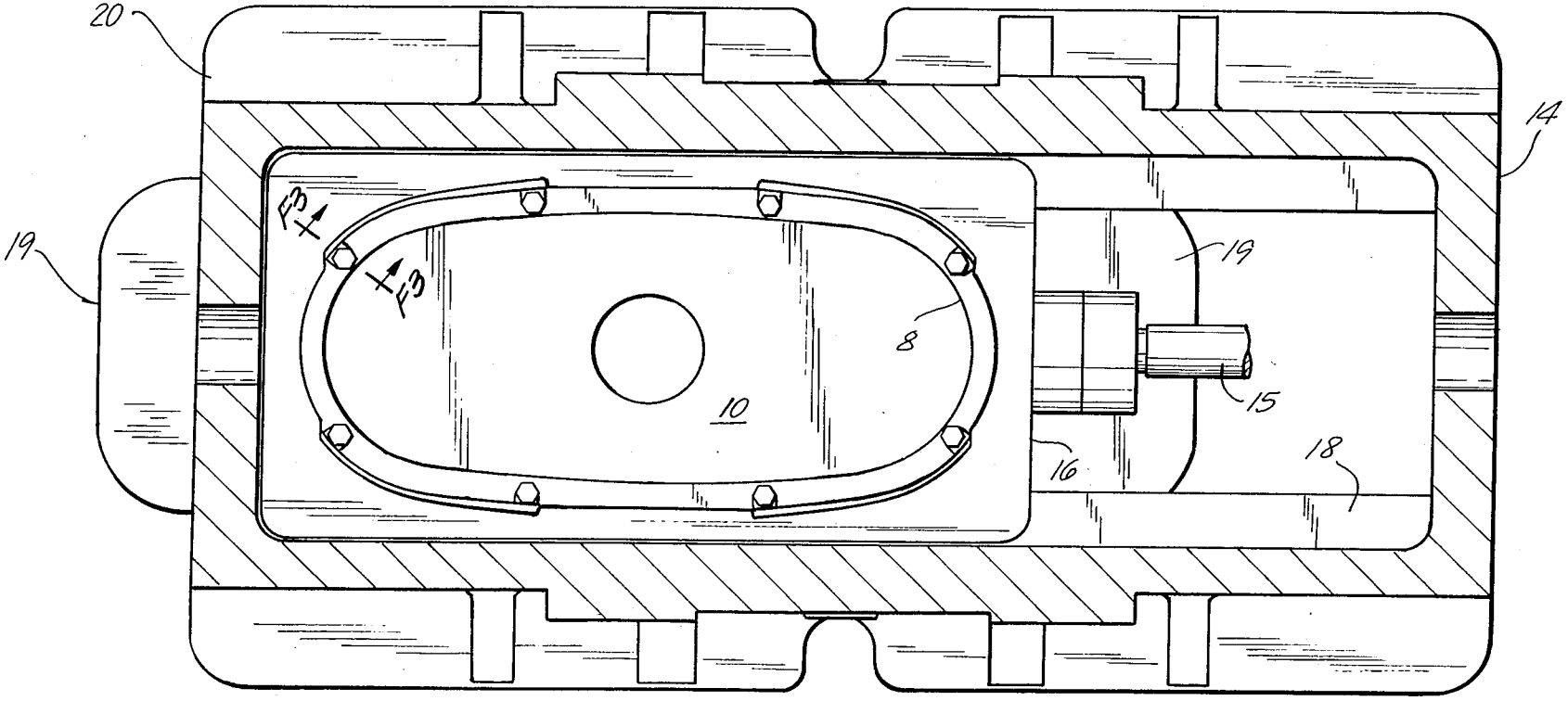
FIG. 2 is a horizontal sectional view taken through the assembly shown in FIG. 1 along section line 2—2 of FIG. 1 and in the same scale as FIG. 1.

The environment for the bandless refractory valve clamp and method includes a teeming vessel 1, such as illustrated in FIG. 1, having a refractory lining 2 and surrounded by a teeming vessel shell 3. An upper well nozzle 4 and lower well nozzle 5 are in teeming communication with the molten metal interiorly of the vessel 1. The lower portion of the teeming vessel shell 3 is engaged by a mounting plate 6 for securing the sliding gate valve in position. A run-out block on the upper portion 7 engages the refractory clamp ring 8 which in turn abuts the stationary plate with nozzle recess 9. The stationary plate 9 has tapered edge portions as will be detailed hereinafter. A special service refractory insert 9*a* is imbedded in a monolith 9*b* in the stationary plate 9. The sliding gate plate 10 is positioned against the stationary plate 9 and has a special service refractory insert 10*a* imbedded in a monolithic casting 10*b* and in the embodiment shown has a tapered boss 10*c* at its lower portion which engages the replaceable collector nozzle 11. The replaceable nozzle 11 is encased in a metal housing and both are tapered towards the lower end of the replaceable collector nozzle 11.

Various shapes are intended for the replaceable bandless refractories. More specifically, as to the stationary plate 9, its external configuration can be a circle, a true ellipse, a multi-elliptical approximating an ellipse, and a multi-elliptical approximating an egg shape. As to the sliding gate plate 10, its shape can be a circle, a true elipse, a multiple radii approximating an ellipse, and a multiple radii approximating an egg shape. Normally it is intended that the shape of the stationary plate 9 and the shape of the sliding gate plate 10 will be essentially the same and complimentary. Indeed, one embodiment is contemplated where both plates are identical and made the same, and provided with mounting facilities to accommodate the same. As to the collector nozzle 11, its shape can be that of a cylinder, or a frustoconical cylinder, or a frustopyramidal shape having at least three equilateral sides.

A spring pressure plate 12 is provided to underly the sliding gate plate 10. The spring pressure plate 12, from its central orifice, has a depending nozzle holder 13. As shown the nozzle holder 13 threadedly engages the upper nozzle holder which, in turn, is secured to and depends from the spring pressure plate 12.

A gate valve frame 14 is provided and secured to the mounting plate 6. A drive connection 15 engages the sliding gate carrier 16. The sliding gate carrier 16 has a bottom 17 which slides on the frame bottom rail 18. Provision is made for a moving heat shield 19 to travel with the collector nozzle 11. A stationary heat shield 20 is connected to the gate valve frame 14 and is provided with a central open area to accommodate the shifting of the slide gate 10 and its replaceable collector nozzle 11.

The spring assemblies 21 are secured within the carrier 16 and yieldably engage the underneath portion of the spring pressure plate 12. A run-out block 22 is provided at the opposite side of the run-out block 7 and it similarly engages the refractory clamp ring 8 to secure the stationary plate 9 against the mounting plate 6.

Provision is made for a leveling plate 23 which interfaces between the mounting plate 6 and the vessel 1 interiorly of the teeming vessel shell 3. The leveling plate 23 is welded to the shell 3.

Figure 4:
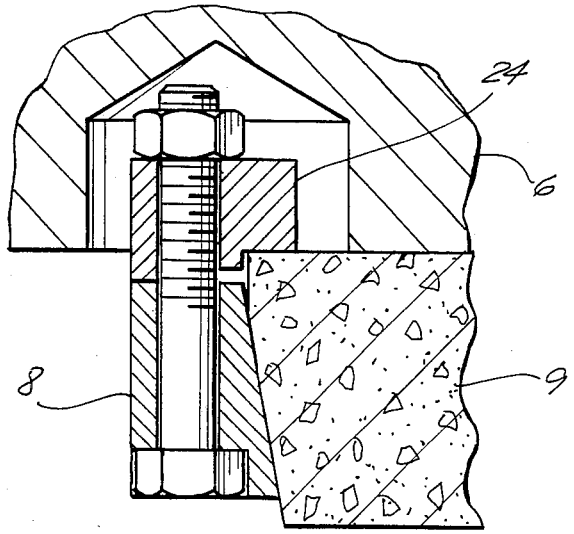
FIG. 4 is a sectional view taken at the circled area F4 on FIG. 1 but in enlarged scale showing the top plate clamp.

Referring now to FIG. 4, it will be seen that the stationary plate 9 is secured by the band 8 which clamps to clamp block 24. This prestresses the ring 8 centrally around the stationary plate 9 and encapsulates the stationary plate 9 to prevent such thermal shock fractures as may be formed during pouring from spreading and allowing molten material intrusion into the fractures.

Figure 5:
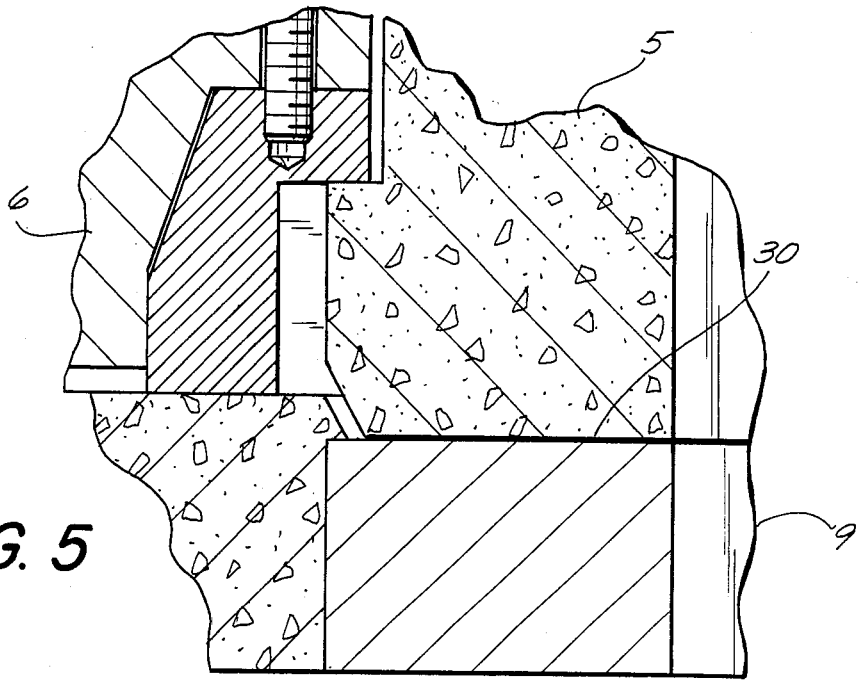
FIG. 5 is taken at the area shown by F5 in FIG. 1 showing in enlarged scale the zero clearance sealing of the stationary plate with the mounting plate and its associated sealing ring.

In accordance with a related aspect of the invention, as noted in FIG. 5, a secondary sealing ring 25 is secured to the mounting plate 6 in surrounding relationship to the lower well nozzle 5. The lower portion of the secondary sealing ring 25 is machined or ground to be flush with the lower face of the mounting plate 6 thereby providing a positive zero clearance seal between the upper portion of the stationary plate 9 and the hardened secondary sealing ring 25. This further precludes any metal-to-metal areas where, if break-out should occur, such break out can accelerate at the joint between two metals. Whenever the joint is metal-to-refractory, or refractory to refractory, and no clearance exists between the members, break-out is significantly reduced or inhibited. The secondary sealing ring 25 is ideally formed from a material hard enough to resist physical damage and having a melting point above the temperature of the material being teemed. Exemplary of such materials are ferrous metal hardened to resist physical damage; any of the refractory metals such as molybdenum, tantalum, titanium, tungsten, vanadium and zirconium; or a high strength refractory such as aluminum oxide, chromaluminum oxide, silicon carbide.

Figure 7:
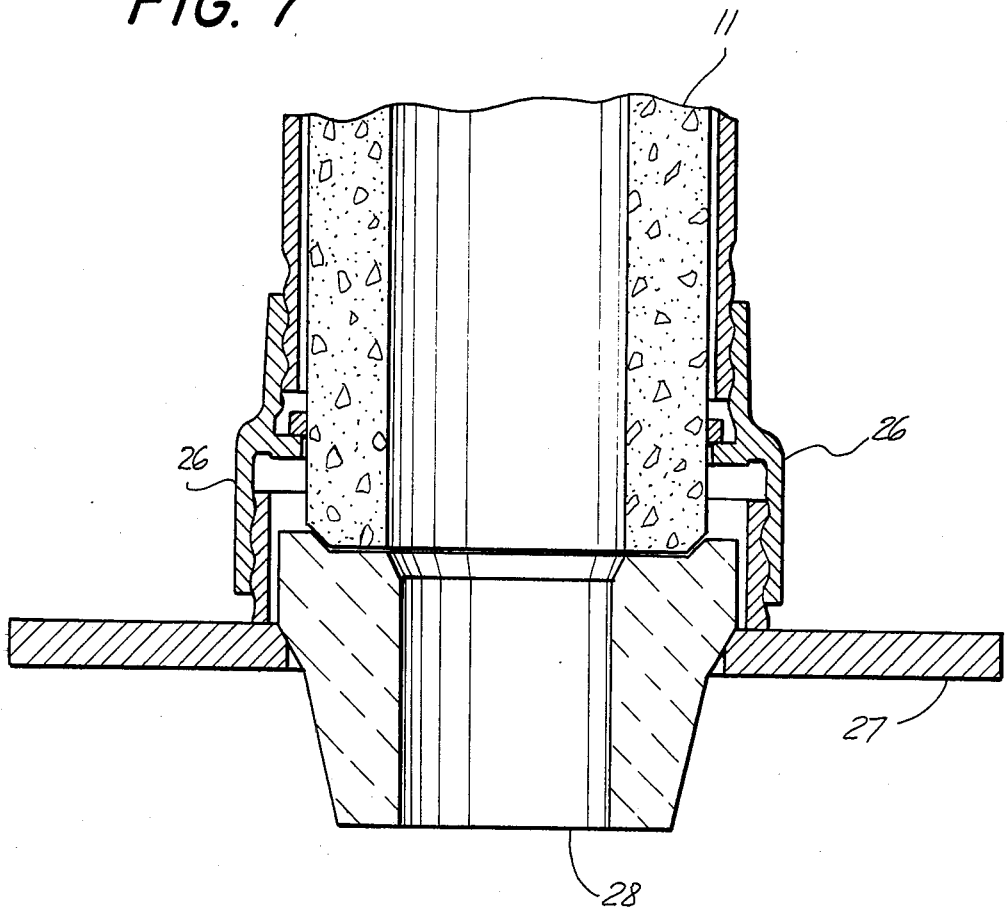
FIG. 7 is an enlarged partially section view showing the mechanism for employing a replaceable tip on the collector.

Noting now FIG. 7, it will be seen that an intermediate holder assembly 26 is employed to engage the tip holder assembly 27 in depending fashion which, in turn, holds the replaceable tip 28 against the lower portion of the collector nozzle 11.

Figure 5A:
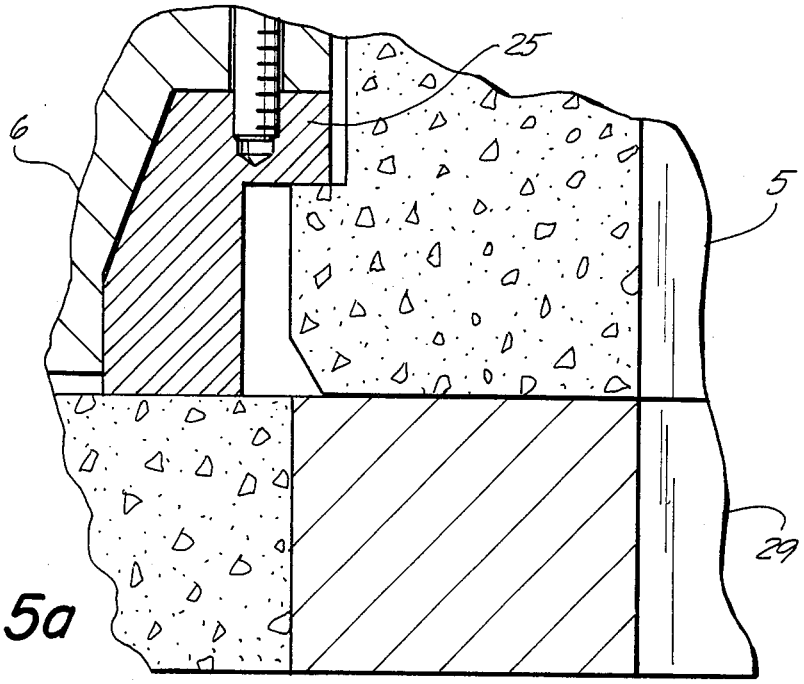
FIG. 5*a* is taken from the same vantage point as FIG. 5 but showing the well nozzle with a secondary sealing and in flush relationship with the upper face of the stationary plate.
Figure 6:
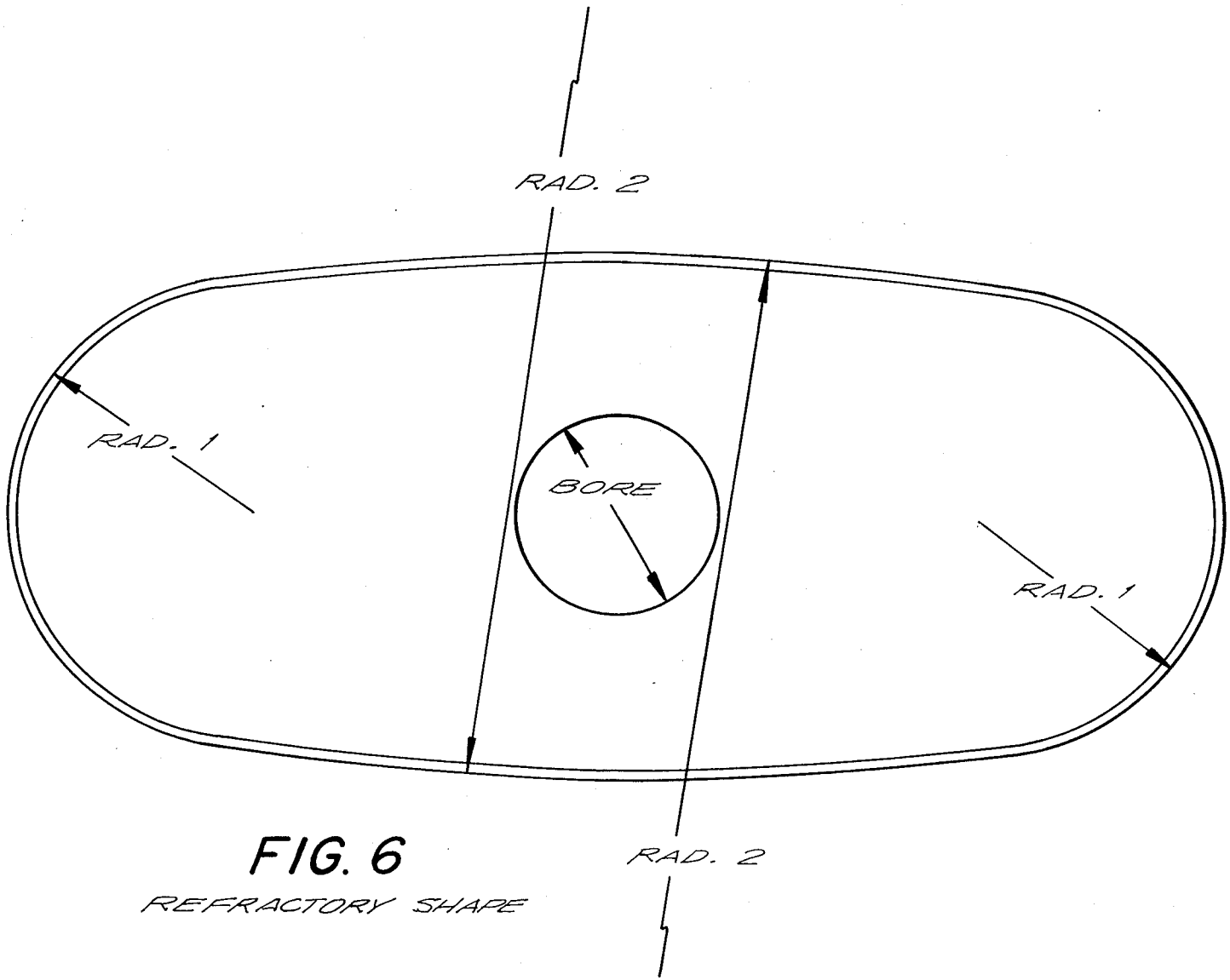
FIG. 6 is a plan view of refractory shape approximating an elipse for both the stationary plate and the slide gate.

In FIG. 5*a*, an alternative form of sealing is provided wherein the stationary top plate 29 has a plane upper face and is not recessed to receive the lower portion of the lower well nozzle 5. Nonetheless the zero clearance seal is still provided by the secondary sealing ring 25. By way of contradistinction, the secondary sealing as shown in FIG. 5 is provided by a primary sealing recess 30 in the upper portion of the stationary plate 9. The exterior portion of the lower nozzle 5, as shown in FIG. 5, is imbedded in place with mortar where it separates against the chamfered face of the monolith portion of the stationary plate 9.

Figure 4A:
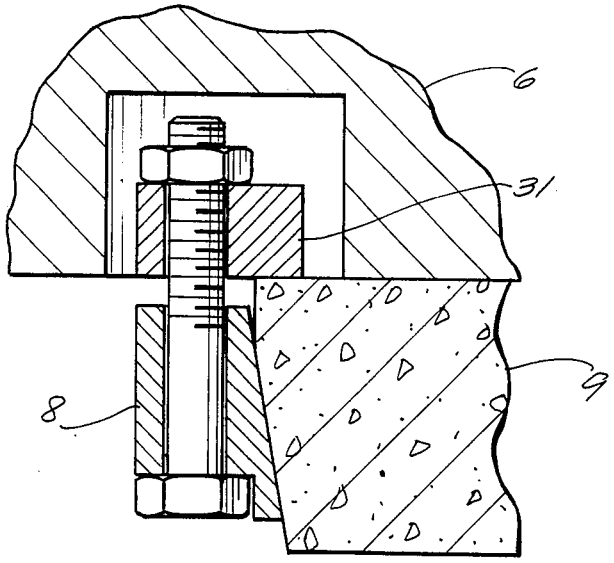
FIG. 4*a* is similar to that shown in FIG. 4 but showing the top plate clamp assembly with a back-up ring.

In another alternative embodiment for the structure of the refractory clamp ring 8 shown in FIG. 4*a*, the back-up ring 31 is co-extensive and in entire surrounding relationship with the stationary plate 9 the same as is refractory clamp ring 8.

Figure 4B:
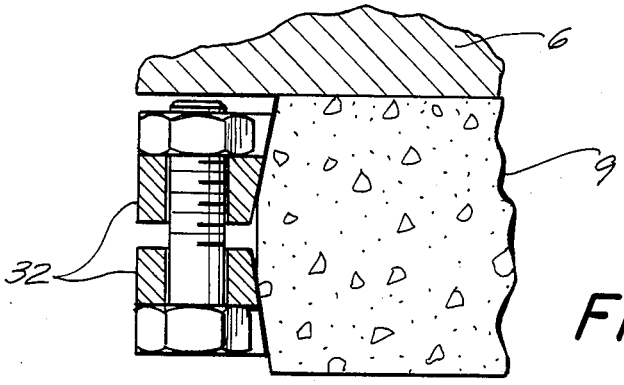
FIG. 4*b* is a showing of a further alternative embodiment of FIG. 4 with a top plate clamp having a dual taper arrangement.

In yet another alternative embodiment, where a double taper is provided on the top plate, as shown in FIG. 4*b*, a pair of mirror image opposed refractory clamp rings 32 are provided which are removably secured in compressive relationship each toward the other which, in turn, causes the refractory of the top plate 9 to be in compression.

Figure 8:
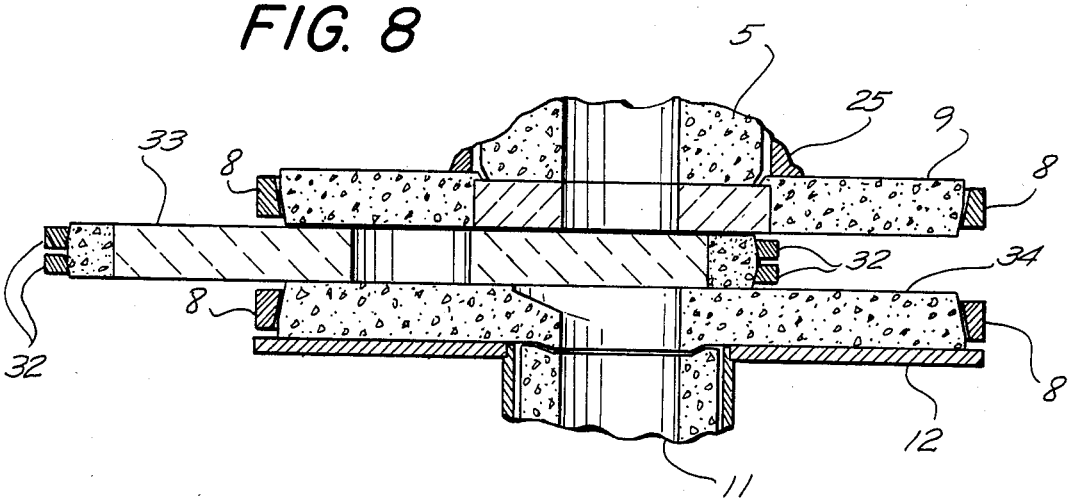
FIG. 8 is a partially diagrammatic view showing the adaptation of the bandless refractory slide gate system to a three plate refractory type environment.

A further embodiment of the present invention in a three plate refractory system is shown in FIG. 8. There it will be seen that a refractory clamp ring 32 is provided to peripherally engage the center sliding plate. Dual tapers are provided on the periphery of the center sliding plate thereby permitting the clamping and retaining centrally compressive engagement of the refractory of the center sliding plate 33. The bottom stationary gate plate 34 is engaged with a ring 8 on its tapered peripheral edge, and the spring plate or pressure plate 12 is secured underneath the refractory of the stationary gate plate 34 and secures the collector nozzle 11 in position.

Figure 3:
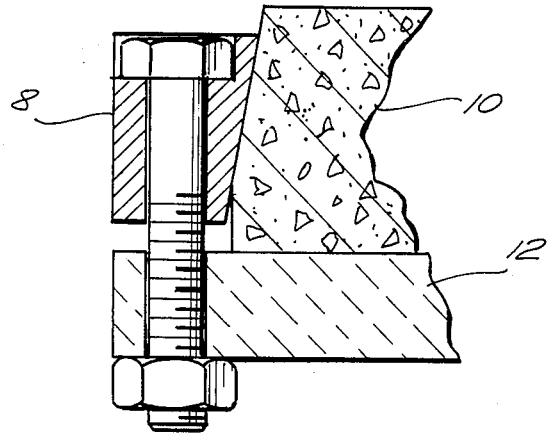
FIG. 3 is taken at area F3 of FIG. 2, and is a transverse sectional view of the clamping arrangement with the sliding gate plate.

The angle at the refractory clamp interface 8, 10 (FIG. 3), 8–9 (FIG. 4), 8–9 (FIG. 4*a*), 32–9 (FIG. 4*b*), 32–33 (FIG. 8) must be an angle greater than a locking taper for the two materials at the interface. This is approximately 7° for the interface. The angle should be less than an angle which would result in a greater parallel force normal to the platen face than inward force parallel to the plate face. This angle is 45°.

What is claimed is:

1. In a sliding gate valve for a teeming vessel having means for mounting the same to the teeming vessel in open communication with a well nozzle at the outer portion of such vessel, the valve including a refractory stationary plate, a refractory sliding gate, means for moving the sliding gate, each of said stationary plate and sliding gate having a teeming opening at a mid-portion thereof, the improvement comprising, a mounting plate for the valve, said mounting plate having a central orifice to receive a sealing ring, a well nozzle having a lower end, said lower end being proportioned for engagement with the stationary plate, a secondary sealing ring having a portion for engaging the well nozzle, means for securing the sealing ring within the mounting plate in machined flush relationship with the mounting plate, the base of the sealing ring and the base of the mounting plate being in positive zero clearance sealed metal to refractory relationship with the stationary plate.

2. In the valve of claim 1 above, said sealing ring being of a material selected from the group comprising hardened ferrous metal, refractory metal, metallic oxide, metallic carbide, metallic nitride.

3. A bandless refractory set for use in a sliding gate valve having a yieldable means for urging two refractory plates having teeming openings in pressure face to face relationship, one plate being a sliding gate and one a stationary plate comprising, in combination, each said plate having curvilinear edge portions, each said plate having opposite faces, one face being a sliding face and one face being a mounting face, each said edge portions having a tapered portion thereon, each said tapered portions being formed to be engaged by a complimentary curvilinear clamping ring, said plate width and length enlarging progressively from the sliding face towards the mounting face along substantially the entire extent of the edge portions.

4. In the sliding gate plate of claim 3, each said plate having a shape selected from the group consisting of a circle, a true ellipse, a multiple radii approximating an elipse, a multiple radii approximating an egg shape.

5. In the sliding gate of claim 4 above, the taper on the side walls of the said plates being at an angle between 7° and 45° with the underneath face of the sliding gate portion.

6. In the sliding gate of claim 4 above, means on the sliding plate for engagement with a collector nozzle.

7. In the sliding gate plate of claim 3, said plate having a special service insert imbedded in a monolithic material.

8. In the sliding gate plate of claim 7, each said insert being thicker than the monolith.

9. A collector nozzle for use with a sliding gate having bandless refractory plates, and a spring pressure plate with depending means for engaging the replaceable collector nozzle and removably replacing such collector nozzle, said collector nozzle having sidewalls and end portions, said collector nozzle sidewalls being encased in a metal ring, and a mounting ring circumferentially secured to the lower portion of the collector nozzle and proportioned to nest in a nozzle holder provided in a position depending from a spring pressure plate.

10. In the collector nozzle of claim 9, said collector nozzle having sidewalls selected from the groups of shapes consisting of a cylinder, a frusto conical cylinder, or a frustopyramidal shape having at least three equilateral sides.

11. In the collector nozzle of claim 9, said end portions being selected from the group of one or more of the shapes including planar, frustoconical, elliptical, hemispherical.

12. A bandless refractory stationary plate for use in a sliding gate valve having a sliding gate in pressure face-to-face relationship with the stationary plate on the sliding face thereof and further having a well nozzle in open communication with the stationary plate, comprising, in combination, a plate having curvilinear edge portions, said plate having opposite faces, one face being a sliding face and one face being a mounting face, said edge portions having a tapered portion thereon tapering outwardly from the sliding face of the refractory, said tapered portions being formed to be engaged by a curvilinear clamping ring, said plate width and length enlarging progressively from the sliding face towards the mounting face along substantially the entire extent of the edge portions.

13. The stationary plate of claim 12, having a shape selected from the group consisting of a circle, a true ellipse, a multielliptical approximating an ellipse, a multielliptical approximating an egg shape.

14. The stationary plate of claim 12, in which the sidewall taper is at an angle between 7° and 45°.

15. In the stationary plate of claim 12, a centrally disposed special service refractory imbedded in a monolithic material.

16. In the stationary plate of claim 5, said centrally disposed refractory insert being thicker than the surrounding monolith.

17. In the stationary plate of claim 12 above, a centrally disposed special service refractory imbedded in a monolithic material, said centrally disposed special service refractory having a dimension in the direction of sliding plate travel greater than the diameter of the well nozzle.

18. A sliding gate plate for use in a sliding gate valve having a pressure plate comprising, in combination, said plate having curvilinear edge portions, said plate having opposite faces, one face being a sliding face and one face being a mounting face, said edge portions having a tapered portion thereon, said plate width and length enlarging progressively from the sliding face towards the mounting face along substantially the entie extent of the edge portions, said tapered portion being formed to be engaged by a clamping ring, a special service insert imbedded in a monolithic material, and said insert being thinner than the monolith.

19. A stationary plate for use in a sliding gate valve having a sliding gate in pressure face-to-face relationship with the stationary plate and further having a well nozzle in open communication with the stationary plate, comprising, in combination, a plate having curvilinear edge portions, said plate having opposite faces, one face being a sliding face and one face being a mounting face, said edge portions having a tapered portion thereon, said plate width and length enlarging progressively from the sliding face towards the mounting face along substantially the entire extent of the edge portions, said tapered portion being formed to be engaged by a clamping ring, a centrally disposed special service refractory imbedded in a monolithic material, said centrally disposed refractory insert being thinner than the surrounding monolith but with its sliding plate interface surface flush with the monolith, whereby a recess is provided on the surface opposite the sliding interface to receive a nozzle.

20. A stationary plate for use in a sliding gate valve having a sliding gage in pressure face-to-face relationship with the stationary plate and further having a well nozzle in open communication with the stationary plate, comprising, in combination, a plate having curvilinear edge portions, said plate having opposite faces, one face being a sliding face and one face being a mounting face, said edge portions having a tapered portion thereon, said plate width and length enlarging progressively from the sliding face towards the mounting face along substantially the entire extent of the edge portions, said tapered portions being formed to be engaged by a clamping ring, a centrally disposed special service refractory imbedded in a monolithic material, said centrally disposed refractory insert being thicker than the surrounding monolith but with its sliding plate interface flush with the monolith, whereby a projection is provided on the surface opposite the sliding interface to engage a nozzle.

21. A bandless refractory sliding gate plate for use in a sliding gate valve having a stationary plate in pressure face-to-face relationship with the sliding gate plate on the sliding face thereof and further having a well nozzle in open communication with the stationary plate, comprising, in combination, a sliding plate having curvilinear edge portions, said plate having opposite faces, one face being a sliding face and one face being a mounting face, said edge portions having a tapered portion thereon tapering outwardly from the sliding face of the refractory, said plate width and length enlarging progressively from the sliding face towards the mounting face along substantially the entire extent of the edge portions, said tapered portions being formed to be engaged by a curvilinear clamping ring.

22. A sliding gate valve for use with a bandless refractory, said valve having a stationary plate and a sliding gate, a carrier for moving the sliding gate, a frame for receiving the carrier, means for driving the carrier, and yieldable means for urging the sliding plate in pressure face-to-face relationship with the stationary plate, said stationary plate and sliding gate each having opposite faces, one face being a sliding face and one face being a mounting face, said plate having a width and length enlarging progressively from the sliding face towards the mounting face along substantially the entire extent of the edge portions, characterized by a curvilinear refractory clamp ring proportioned to encircle the sliding plate, a curvilinear clamping ring proportioned to engage the stationary plate, each said clamping ring having a tapered face proportioned to matingly engage the tapered edge portions of the respective refractories, and means for securing said rings to the structure of the valve to thereby create a central compressive force component, and a clamping component in the direction of the member to which each refractory member is secured.

23. In the valve of claim 24, said encircling ring like clamp having a backup ring which is co-extensive and in surrounding relationship with the stationary plate.

24. A sliding gate valve comprising, in combination, an upper stationary plate and a lower stationary plate, a central shiftable plate having an aperture therein, each of said stationary plates having an aperture therein and coaxial with each other, power means for moving the central reciprocating plate, means for holding all three plates in pressure face-to-face relationship, each stationary plate being characterized by opposite faces, one face being a sliding face and one face being a mounting face, said edge portions having a tapered portion thereon tapering outwardly from the sliding face of the refractory, said taper portions being formed to be engaged by a curvilinear clamping ring, said plate width and length enlarging progressively from the sliding face towards the mounting face along substantially the entire extent of the edge portions.

* * * * *